US005282541A

United States Patent [19]

Chen

[11] Patent Number: 5,282,541

[45] Date of Patent: Feb. 1, 1994

[54] CAP LOCKING DEVICE FOR A WATER BOTTLE

[76] Inventor: Wen-Yen Chen, 9F-4, 159, Section 3, Si-Men Road, Tainan, Taiwan

[21] Appl. No.: 62,236

[22] Filed: May 17, 1993

[51] Int. Cl.[5] ..... B65D 51/18

[52] U.S. Cl. ..... 215/229; 215/1 A; 215/245; 215/237; 220/408; 220/410; 220/737; 220/739; 220/740; 220/705; 220/709; 220/634; 220/459; 220/254; 222/514; 222/538; 222/464

[58] Field of Search ..... 215/229, 1 A, 245, 237; 220/408, 410, 411, 737, 739, 740, 705, 709, 634, 459, 254; 222/514, 538, 464

[56] References Cited

U.S. PATENT DOCUMENTS 2,715,326 8/1955 Gits ..... 220/410 X
4,448,316 5/1984 Hiroshige ..... 215/1 A
4,591,066 5/1986 Moen ..... 220/63 X
4,925,040 5/1990 Wang ..... 215/1 A
5,203,468 4/1993 Hsu ..... 220/705 X

*Primary Examiner*—Allan N. Shoap
*Assistant Examiner*—Paul A. Schwarz
*Attorney, Agent, or Firm*—Pro-Techtor International

[57] ABSTRACT

A cap locking device for a water bottle comprising a bottle cap threadably closing an inner bottle, a push button and a nipple pusher, the bottle cap shaped like a shell head having a diametric opening, a tubular post in the opening for a nipple fixed on top of a drinking tube extending vertically in the inner bottle to fit therein, a push button pivotally fitted in one side portion of the opening and the liftable nipple pusher pivotally fitted in another side portion of the opening, the liftable nipple pusher pushed down to close the opening or raised up to open the opening by pushing the push button for the nipple exposed for sucking the content of the inner bottle contained in an outer bottle.

4 Claims, 4 Drawing Sheets

CAP LOCKING DEVICE FOR A WATER BOTTLE

BACKGROUND OF THE INVENTION

A conventional water bottle, a canteen or a flask generally has a rounded body, a narrow neck, a stopper and a cup. They have several disadvantages as follows.

1. The stopper and the cup have to be removed first.
2. In case the bottle should be turned upside down with the stopper removed, water therein would quickly escape.
3. The bottle may be broken easily if it is carelessly dropped on the ground, especially when filled with water.

SUMMARY OF THE INVENTION

This invention has been devised to offer a kind of a cap locking device for a water bottle, the content of which a user can drink through a nipple fixed on a drinking tube deposited therein. The user needs only to push a button to swing open a liftable nipple pusher, and does not need to take off a bottle cap.

A main feature of the locking cap device for a water bottle in the present invention is that a dome-shaped bottle cap is provided to threadably close an upper open end of an inner bottle. The cap has a diametrical opening, a tubular post axially extending up in the opening, a hole in the tubular post extending down through the bottle cap, a push button pivotally connected with and in one side portion of the opening, and a liftable nipple pusher pivotally connected with and in another side portion of the opening. The push button has an inner projection on a lower end for a coil spring to urge against and a locking edge on an upper end. The liftable nipple pusher has an elastic piece extending down from a lower end, and a hook on an upper end to engage the hooking edge of the push button so as to keep the liftable nipple pusher closed on the opening of the bottle cap when this bottle is not in use. The liftable nipple pusher is swung open to expose the nipple fixed on top of the drinking tube when the push button is pressed.

DETAILED DESCRIPTION OF THE INVENTION

Figure 1:
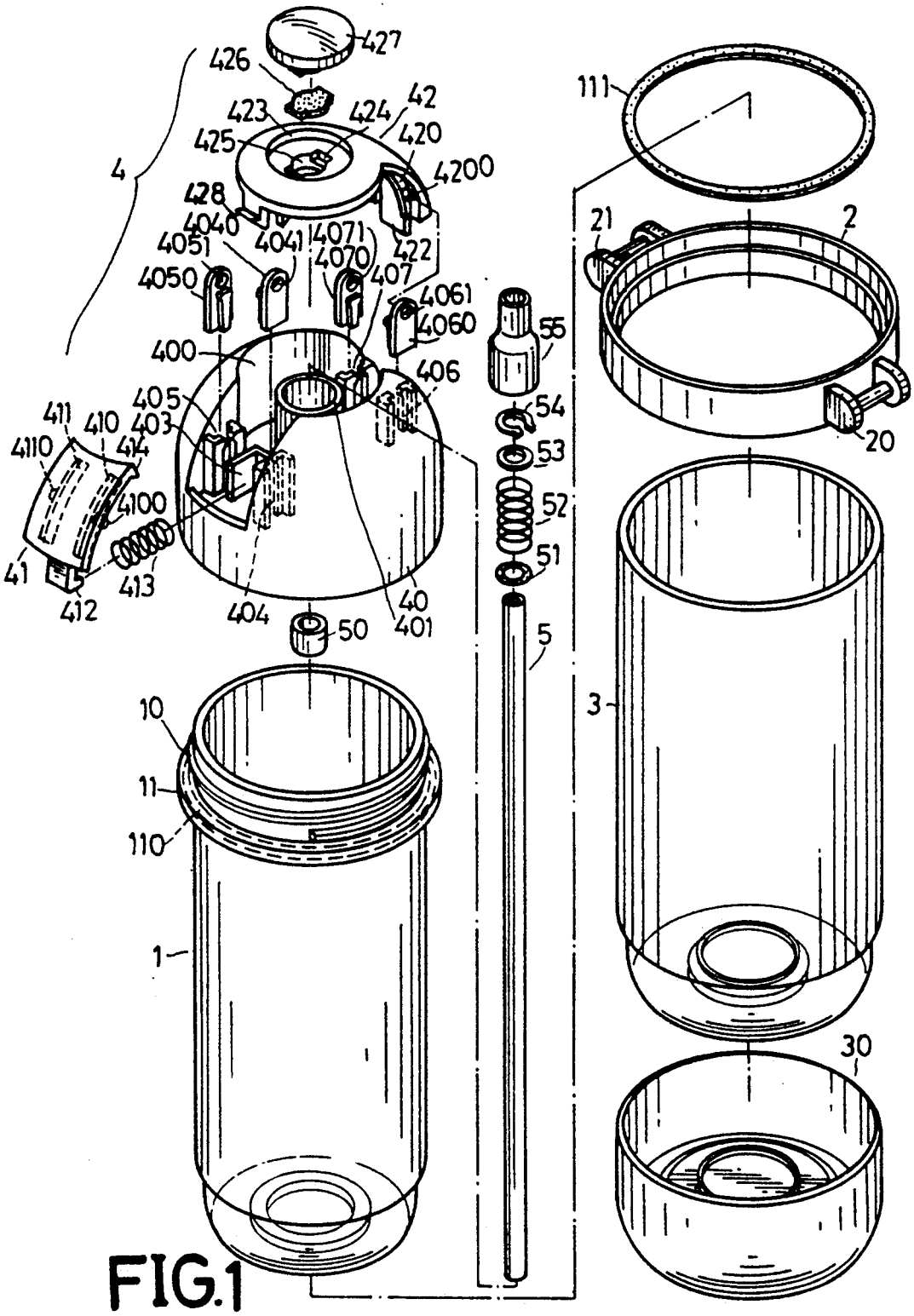
FIG. 1 is an exploded perspective view of a cap locking device for a water bottle in the present invention.
Figure 2:
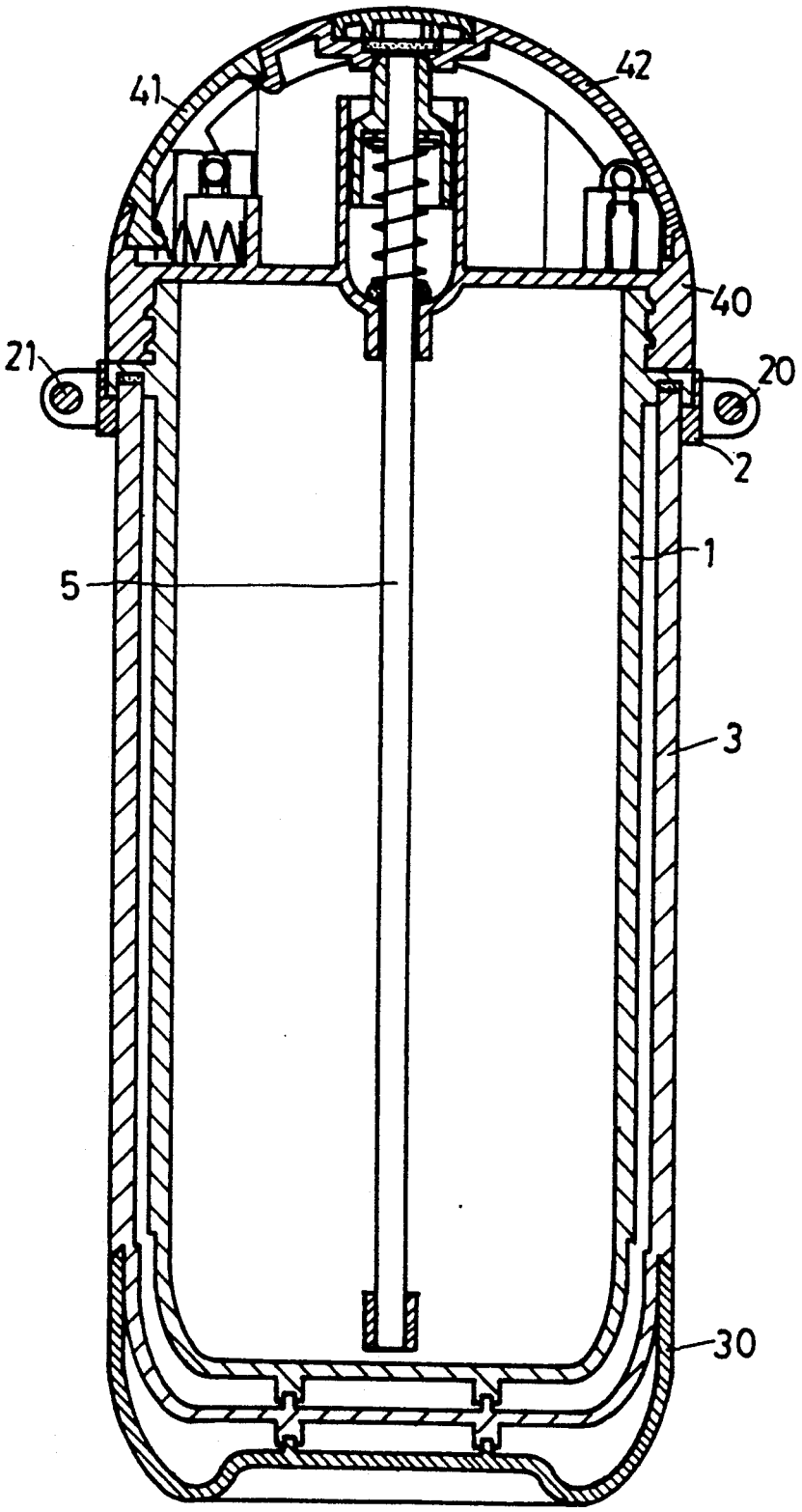
FIG. 2 is a cross-sectional view of the cap locking device for a water bottle in the present invention.
Figure 3:
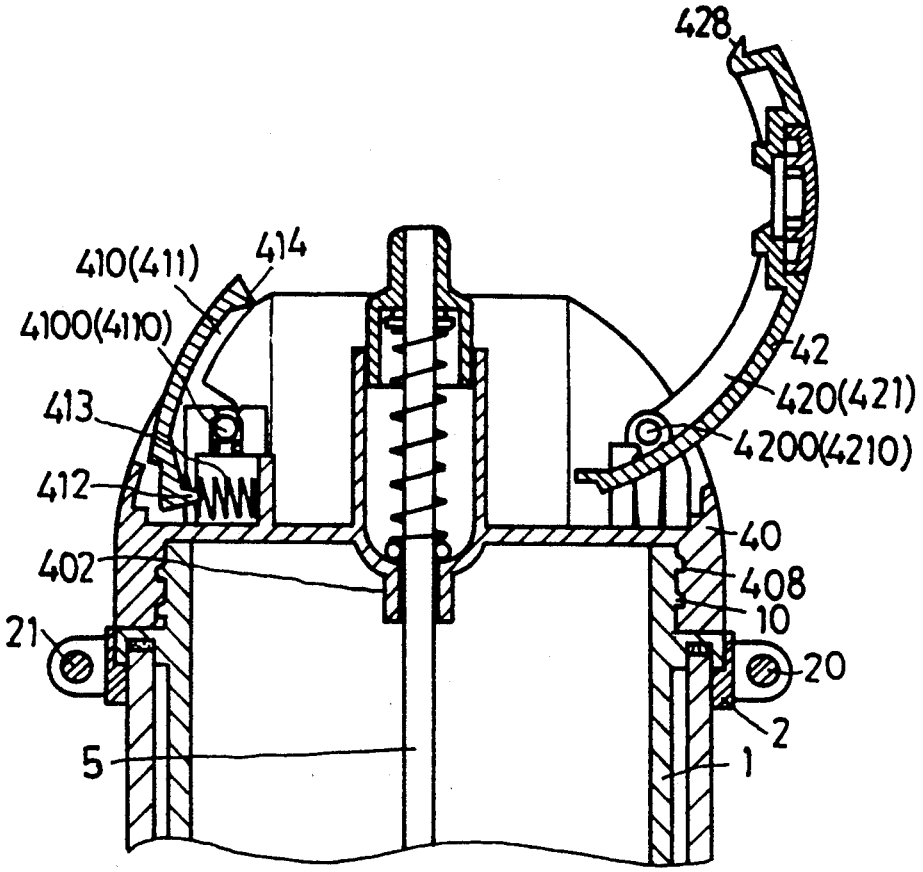
FIG. 3 is a cross-sectional view of the cap locking device for a water bottle in the present invention showing the cap in its open position.

A cap locking device used in a water bottle in the present invention, as shown in FIGS. 1–3, comprises an inner bottle 1, a pinching ring 2, an outer bottle 3, a bottle cap 4, and a sucking tube 5 as main components.

The inner bottle 1 has a threaded portion 10 at its top end, a protective annular projection 11 below the thread 10, an annular inner groove 110 on the lower surface of the protective annular projection 11, and a rubber gasket 111 fitted in the inner groove 110.

The pinching ring 2 is fitted around the protective projection 11 of the inner bottle 1 and includes two different diameter inner walls and two pairs of projections 20, 21 on opposite sides of its outer wall and a small rod between each pair of projections 20, 21.

The outer bottle 3 contains the inner bottle 1 and is held tightly in the pinching ring 2. A bottom cap 30 fits around a bottom end of the outer bottle 3 to prevent the outer bottle 3 from breaking when dropped or struck.

The bottle cap 4 screws onto the inner bottle 1, and has a cap body 40, a push button 41, and a liftable nipple pusher 42. The cap body 40 is dome-shaped, having an upper diametric opening 400 nearly watch-shaped, a tubular post 401 protruding in the opening 400 and having a hole 402 extending downward. A hamper wall 403 is provided in a left central portion of the opening 400. On two opposing left side walls of the opening 400 are provided two chambers 404, 405. Two pivotal blocks 4040, 4050 are respectively fitted in the two chambers 404, 405. The two pivotal blocks 4040, 4050 having respectively a pivotal hole 4041, 4051. On two opposing right side walls of the opening are also provided two chambers 406, 407, in which are inserted two pivotal blocks 4060, 4070 having respectively a pivotal hole 4061, 4071. The bottle cap body 40 has a female thread 408 in a lower inner end.

The push button 41 is pivotally assembled in the pivotal holes 4041, 4051 of the pivotal blocks 4040, 4050 of the bottle cap body 40, having two parallel projecting ridges 410, 411 on an inner surface. The push button 41 includes two pivotal shafts 4100, 4110, an L-shaped projection 412 extending from a lower end, a coil spring 413 provided between the projection 412 and the hamper wall 403, and a hooking edge 414 on an upper end.

A liftable nipple pusher 42 is provided to pivotally insert in the pivotal holes 4061, 4071 of the pivotal blocks 4060, 4070 of the bottle cap body 40. The nipple pusher 42 has two projecting edges 420, 421, two pivotal shafts 4200, 4210 at both sides of a lower end of the edges 420, 421, an elastic piece 422 extending down from the bottom of the edge, a round opening 423 in a top surface, a recess 424 in the opening 423, a hole 425 in the recess 424, and a hook 428 on an upper end. A soft gasket 426 and a push block 427 are placed in the recess 424 and the round opening 423 respectively.

A sucking tube 5 is provided to extend through the hole 402 of the bottle cap body 40 into an interior of the inner bottle 1. A tubular stopper 50 is fixed around a bottom end of the sucking tube 5 to prevent the tube 5 from being pulled out of the inner bottle 1. A ring 51, a coil spring 52, a washer 53, a C-shaped retainer 54, and a nipple 55 are fixed in order on an upper end of the tube 5.

Figure 4:
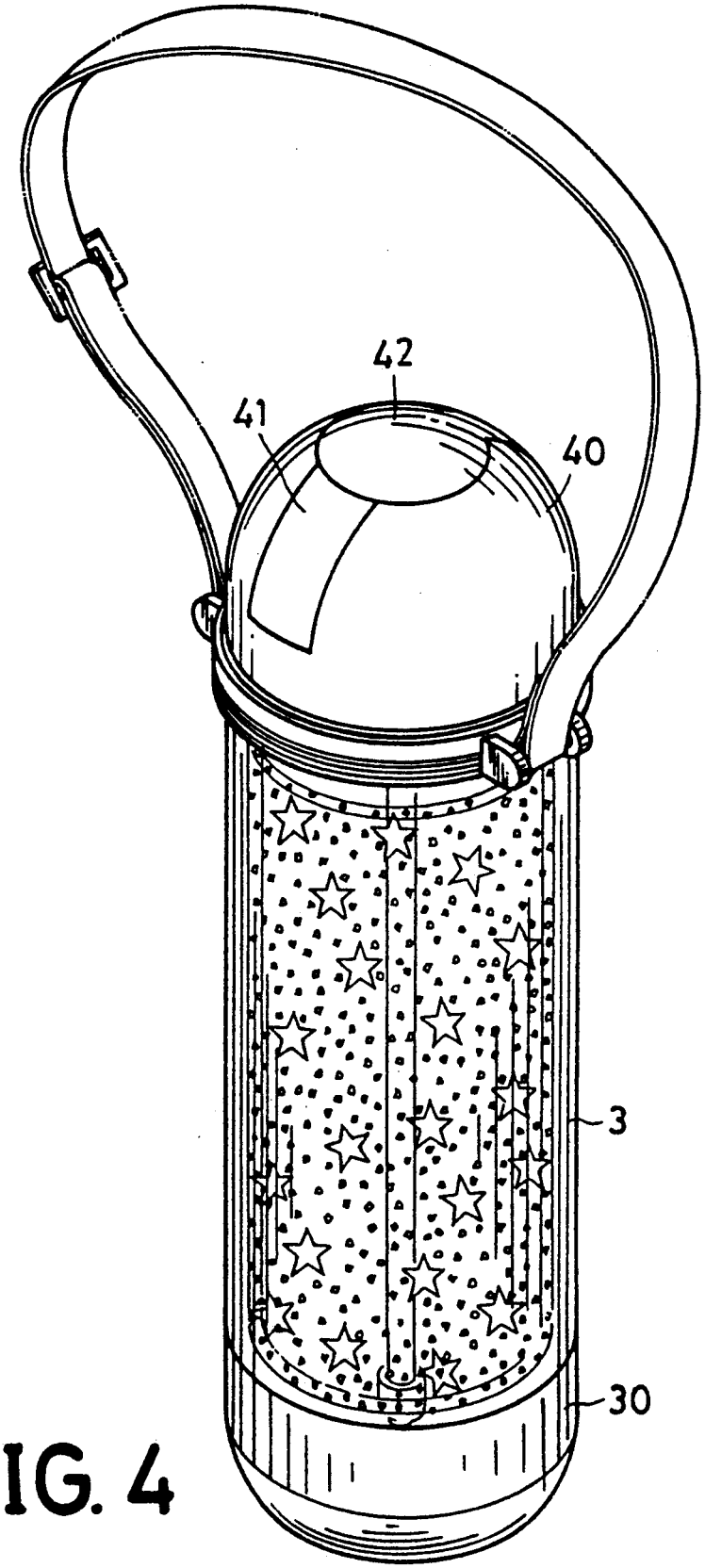
FIG. 4 is a perspective view of the cap locking device for a water bottle in the present invention.

To assemble the device, first the rubber gasket 111 is fitted in the annular groove 110 of the protective ring 11, and the pinching ring 2 is fixed around the protective ring 11 of the inner bottle 1. Then the protective cap 30 is fixed around the bottom of the outer bottle 3, and then the inner bottle 1 is deposited in the outer bottle 3 and tightly held in the pinching ring 2. Then water and little star-shaped ornaments or glittering bits are filled in the space between the outer and the inner bottles 3, 1 as shown in FIG. 4. After that, the gasket 426 and the push block 427 are fitted into the groove 424 and the round hole 423 of the nipple pusher 42, and the spring 413 is placed on the projection 412 of the push button 41. Then in the pivotal holes 4041, 4051, 4061, 4071 of the four pivotal blocks 4040, 4050, 4060, 4070 are fitted the pivotal shafts 4100, 4110, 4200, 4210 of the liftable nipple pusher 42. In the four chambers 404, 405, 406, 407, respectively are fitted the four pivotal blocks 4040, 4050, 4060, 4070, so the bottle cap 4 is fully assembled.

Next, the ring 51, the spring 52, the washer 53, the C-shaped retainer 54 and the nipple 55 are fixed on the top end of the sucking tube 5 which is then pushed down through the hole 402 and vertically down through the bottle cap 4. The tubular stopper 50 is fixed around the bottom end of the sucking tube 5. Lastly, the bottle cap 4 is screwed onto the inner bottle 1.

In use, the liftable nipple pusher 42 is pressed down, compressing the elastic piece 422 against the cap body 40. The hook 428 is hooked by the hooking edge 414 of the push button 41, so the nipple pusher 42 is in closed condition. The sucking tube 5 is then pressed downward, with the coil spring 52 compressed. If the liftable nipple pusher 42 is to be opened, it is enough to press the lower end portion of the push button 41. This releases the hook 428 from the hooking edge 414. Then the liftable nipple pusher 42 is lifted open by the tension in the elastic piece 422, which recovers its own elasticity. The sucking tube 5 is also pushed up by the elasticity of the coil spring 52 which was compressed by the liftable nipple pusher 42. A user can then suck the contents of the inner bottle 1 through the tube 5.

What is claimed is:

1. A water bottle with a locking cap comprising;

an inner bottle having a male thread on an upper end, a protective annular projection under the male thread, and a rubber annular gasket under the projection;

a pinching ring fitting tightly around the annular projection of the inner bottle, and having an inner wall with two different diameters and two pairs of projections with a small rod between each pair of projections on two opposite outer walls;

an outer bottle for containing the inner bottle, the outer bottle also being tightly held in the pinching ring;

a bottle cap having a cap body with a dome shape, a push button, and a liftable nipple pusher;

a sucking tube which extends through the bottle cap into an interior of the inner bottle, having a lower end fixed with a tubular stopper and an upper end upon which are fixed a ring, a coil spring, a washer, a C-shaped retainer and a nipple in order, the coil spring being contained between the ring on one end and the washer and C-shaped retainer on the other in a tubular post in the cap body such that the sucking tube is urged upward; and said cap body having a central diametric opening in an upper portion, the tubular post projecting upward in the diametric opening, diametric opening having opposing portions, said push button being pivotally connected in one of said opposing portions, said liftable nipple pusher pivotally connected in the other of said opposing portions, said push button having an inner projection on its lower end and a coil spring urging the inner projection and a hooking edge on its upper end, said nipple pusher having an elastic piece extending down from a lower end, and a hook at an upper end, said nipple pusher being pivotally pressed down to close the diametric opening of the cap body and compressing the elastic piece and permitting the hook to engage the hooking edge of said push button, said liftable nipple pusher being pivotally raised up by the elastic piece by pressing manually the push button and forcing the hooking edge to unhook from the hook of the nipple pusher, and said nipple with the sucking tube being raised up for a user to suck the contents of the bottle.

2. The cap locking device for a drinking bottle as claimed in claim 1, wherein there is a space between said inner bottle and said outer bottle for containing water with decorative matter.

3. The cap locking device for a drinking bottle as claimed in claim 2, wherein the decorative matter is glittering bits mixed therein.

4. The cap locking device for a water bottle as claimed in claim 1, wherein a protective bottom cap is fixed around the bottom of the outer bottle to protect the outer bottle from breaking by direct exterior force or shock.

* * * * *